US009504892B2

(12) United States Patent
Saphire

(10) Patent No.: US 9,504,892 B2
(45) Date of Patent: Nov. 29, 2016

(54) GAME APPARATUS AND METHOD OF PLAYING THE SAME

(71) Applicant: Jason Saphire, Boston, MA (US)

(72) Inventor: Jason Saphire, Boston, MA (US)

( * ) Notice: Subject to any disclaimer, the term of this patent is extended or adjusted under 35 U.S.C. 154(b) by 93 days.

(21) Appl. No.: 14/632,635

(22) Filed: Feb. 26, 2015

(65) Prior Publication Data

US 2015/0165288 A1 Jun. 18, 2015

Related U.S. Application Data

(62) Division of application No. 13/538,115, filed on Jun. 29, 2012, now abandoned.

(60) Provisional application No. 61/504,081, filed on Jul. 1, 2011, provisional application No. 61/513,928, filed on Aug. 1, 2011.

(51) Int. Cl.

| | |
|---|---|
| ***A63B 61/00*** | (2006.01) |
| ***A63B 61/04*** | (2006.01) |
| ***A63B 67/00*** | (2006.01) |

(52) U.S. Cl.

CPC ..... *A63B 61/003* (2013.01); *A63B 61/04* (2013.01); *A63B 67/002* (2013.01); *A63B 2209/10* (2013.01)

(58) Field of Classification Search

CPC ..... A63B 67/00; A63B 67/04; A63B 67/18; A63B 61/00; A63B 61/003

See application file for complete search history.

(56) References Cited

U.S. PATENT DOCUMENTS

| | | | | |
|---|---|---|---|---|
| 2,497,925 | A | 2/1950 | Bergerioux | |
| 2,615,715 | A | 10/1952 | Moore | |
| 3,452,985 | A * | 7/1969 | Zmura | A63B 67/04 108/66 |
| 4,014,521 | A | 3/1977 | Berman | |
| 4,108,434 | A | 8/1978 | Royer | |
| 4,335,877 | A | 6/1982 | Long | |
| 4,436,304 | A | 3/1984 | Castleman et al. | |
| 4,522,395 | A | 6/1985 | Arndt | |
| 5,674,139 | A * | 10/1997 | Brooks | A63B 67/002 473/473 |
| 5,692,978 | A | 12/1997 | Hummel | |
| 5,827,137 | A | 10/1998 | Ishino | |
| 6,287,220 | B1 | 9/2001 | Caruso | |
| 7,311,617 | B2 | 12/2007 | Langhorn | |
| 7,367,907 | B1 | 5/2008 | Sutton et al. | |
| 7,608,000 | B2 | 10/2009 | Butler | |
| 7,637,827 | B2 | 12/2009 | Bangerter | |
| 7,727,091 | B2 | 6/2010 | Allen | |
| 8,430,772 | B1 | 4/2013 | Jones | |
| 2003/0144090 | A1 | 7/2003 | Belik | |
| 2004/0005941 | A1 * | 1/2004 | Chen | A63B 67/04 473/496 |
| 2006/0116226 | A1 * | 6/2006 | Padilla | A63B 61/02 473/492 |
| 2007/0138453 | A1 | 6/2007 | Le | |
| 2007/0191132 | A1 | 8/2007 | Bangerter | |
| 2007/0298914 | A1 * | 12/2007 | Allen | A47B 25/003 473/496 |
| 2009/0293411 | A1 | 12/2009 | Benner et al. | |
| 2013/0005515 | A1 | 1/2013 | Saphire | |

OTHER PUBLICATIONS www.gophersport.com; "4-Way Accessory Net"; 1 page; 2011.

* cited by examiner

*Primary Examiner* — Raleigh W Chiu

(74) *Attorney, Agent, or Firm* — Stetina Brunda Garred and Brucker

(57) ABSTRACT

Provided are various embodiments of a net system which includes a perpendicularly intersecting net apparatus which allows individuals to play a game combining features of conventional volleyball and conventional four square. The net system includes a first net portion, a second net portion, a third net portion, and a fourth net portion which intersect at a midpoint to form a cross or "+" shape.

18 Claims, 7 Drawing Sheets

GAME APPARATUS AND METHOD OF PLAYING THE SAME

CROSS-REFERENCE TO RELATED APPLICATIONS

This application is a divisional application of U.S. patent application Ser. No. 13/538,115, filed Jun. 29, 2012, which claims the benefit of U.S. Provisional Application No. 61/504,081, filed Jul. 1, 2011, and U.S. Provisional Application No. 61/513,928, filed Aug. 1, 2011, the contents of which are expressly incorporated herein by reference.

STATEMENT RE: FEDERALLY SPONSORED RESEARCH/DEVELOPMENT

Not Applicable

BACKGROUND OF THE INVENTION

Technical Field of the Invention

The present invention relates generally to a game apparatus, and more specifically to an apparatus for playing a multi-player game wherein a projectile is volleyed over an elevated barrier comprised of perpendicular partitions.

Description of the Related Art

Games involving balls or other projectiles are very common. In many games, the ball or projectile is played on a court or playing surface having a net or barrier over which the projectile is propelled. Exemplary games include volleyball, tennis, table tennis, badminton, or the like, wherein a ball, shuttlecock, or other projectile is launched/volleyed over the nets. Such games provide enjoyment to individuals of all ages.

In most of the above-mentioned games, the net is erected to divide the playing surface into two areas which are "defended" by opposing teams. The net is generally supported by two support poles which are secured to the ground in spaced relation to each other. Along these lines, many public locations, such as beaches, parks, schools, etc. include dedicated areas for playing such games, wherein support poles are permanently secured to the ground. For instance, it is common for a beach to include volleyball poles properly positioned to allow a user to attach his net thereto for playing beach volleyball. Likewise, public tennis courts commonly include support poles and a tennis net connected to the support poles in an erected position for users to enjoy.

In addition to the foregoing net/barrier games, another common pastime is the game of Four Square, which is typically played on a playing surface without a barrier. The game is commonly played with a resilient/bouncy ball on a solid ground surface, such as concrete or asphalt. Boundaries for the playing surface are marked on the ground to define a large square that is equally divided into four smaller squares. To begin play, players typically enter the large square and each individual player stands in one of the four interior play areas. The ball is served to begin a rally by hitting the ball by hand into any one of the other boxes. More specifically, once the ball is served, the ball enters one of the other internal play zones. The ball is allowed to bounce once, and then the player in that box must strike the ball such that it may bounce within another interior box before the ball bounces again. The rally continues by players striking and returning the ball to other internal play boxes until a player is unable to successfully return the ball to bounce within another player's box.

There appears to be a need in the art for a game apparatus which combines the excitement of the net/projectile games discussed above with the enjoyable characteristics of Four Square. Furthermore, there is also a need for certain aspects of such an apparatus to be easily adaptable for use with existing nets/barriers, such as existing volleyball or badminton nets.

BRIEF SUMMARY OF THE INVENTION

The present invention specifically addresses and alleviates the above-identified deficiencies in the art. There is provided various embodiments of a net system which includes a perpendicularly intersecting net apparatus which allows individuals to play a game combining features of conventional volleyball and conventional four square. The net system includes a first net portion, a second net portion, a third net portion, and a fourth net portion which intersect at a midpoint to form a cross or "+" shape.

It is envisioned that the net system may be manufactured in three models: 1) one integral net system defining the intersecting X-shape (referred to herein as "model 1"); 2) a kit comprising two "net-halves" which may be connected to an existing volleyball net (referred to herein as "model 2"); and 3) a kit or method which combines two existing volleyball nets (referred to herein as "model 3").

The model 1 apparatus may be formed in two variations. The first variation is more simplified and merely includes two intersecting nets, with no center pole. The second variation is more complex and includes a center sleeve through which a center pole may be advanced during assembly and tear-down of the apparatus.

The model 2 kit includes two net-halves (shown in blue) which are attached to the midpoint of an existing volleyball net (shown in red). Mechanical fasteners are used to join the net-halves to the existing volleyball net. It is also contemplated that the two net-halves may be joined together to define a conventional volleyball net and may be used independent of the existing volleyball net.

The model 3 kit combines two existing volleyball nets to place the nets in the criss-cross configuration. Each net is folded to define a right angle, and the two nets are combined at their apex. Mechanical fasteners are used to joint the two nets at their apex.

The present invention is best understood by reference to the following detailed description when read in conjunction with the accompanying drawings.

BRIEF DESCRIPTION OF THE DRAWINGS

These as well as other features of the present invention will become more apparent upon reference to the drawings wherein.

Common reference numerals are used throughout the drawings and detailed description to indicate like elements.

DETAILED DESCRIPTION OF THE INVENTION

Figure 1:
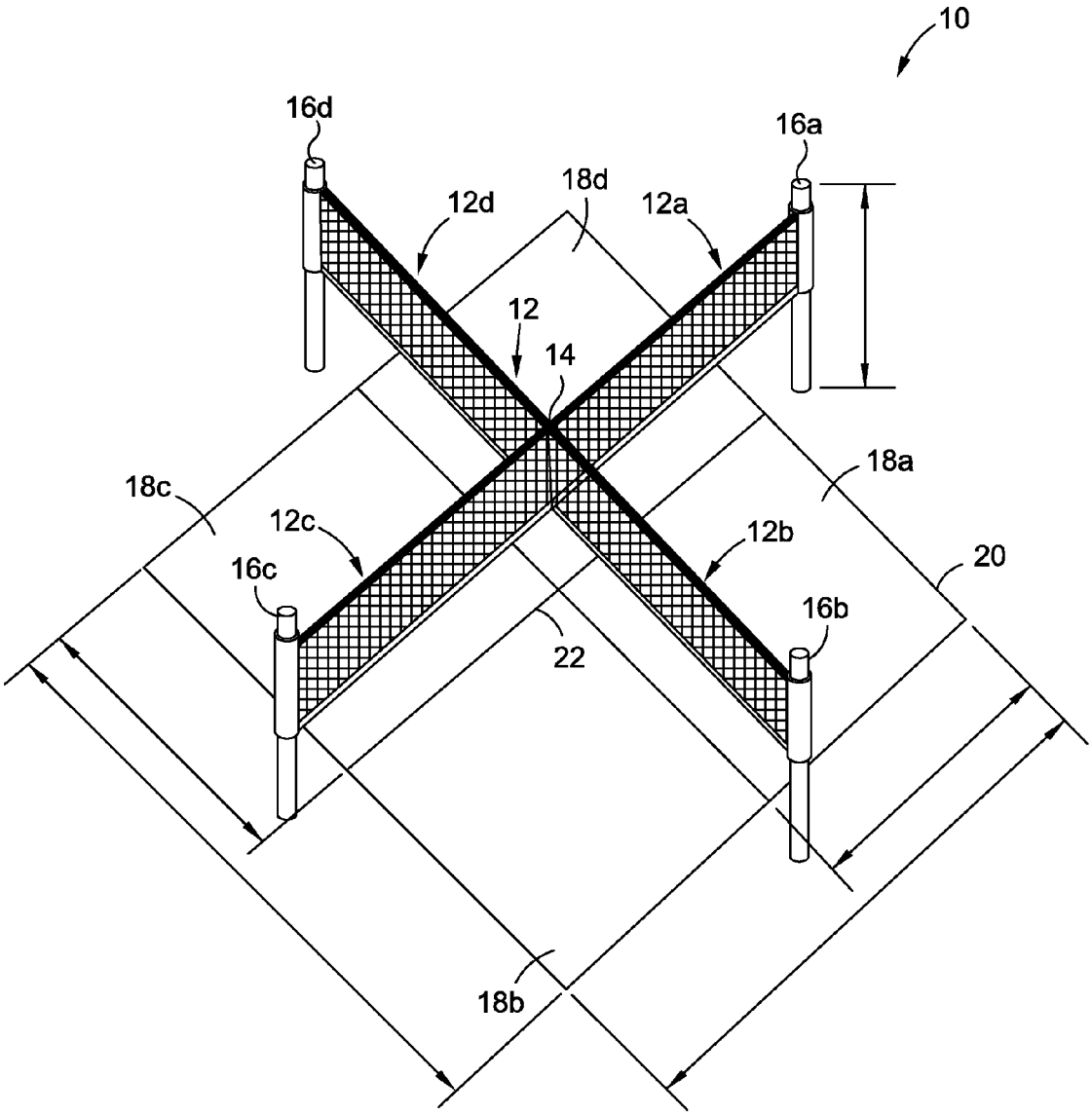
FIG. 1 is an upper perspective view of a game apparatus constructed in accordance with an embodiment of the present invention.

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Referring now to the drawings wherein the showings are for purposes of illustrating a preferred embodiment of the present invention only, and not for purposes of limiting the same, there is provided a game apparatus 10 including a generally perpendicular net system 12 for playing a game wherein a projectile, such as a volleyball, is volleyed over the net system 12. The game may be played by multiple players and may incorporate aspects of volleyball and four-square.

The net system 12 depicted in FIG. 1 includes a first net portion 12*a*, a second net portion 12*b*, a third net portion 12*c*, and a fourth net portion 12*d* which intersect at a central intersection 14. The net portions 12*a*-12*d* are arranged to define a pair of generally perpendicular intersecting planes. Along these lines, each net portion 12*a*-12*d* is arranged in generally perpendicular alignment to two other net portions 12*a*-12*d*, and in generally co-planar alignment with the remaining net portion 12*a*-12*d*. For instance, the first net portion 12*a* is in generally perpendicular alignment with the second net portion 12*b* and the fourth net portion 12*d*, and in generally co-planar alignment with the third net portion 12*c*. As will be described in more detail below, various aspects of the present invention include a net system 12 wherein the net portions 12*a*-12*d* are formed from a single, integral net, or a combination of net(s) and net sections which are connectable to each other to define the net system 12 depicted in FIG. 1.

The net system 12 in FIG. 1 is shown in a deployed state with each net portion 12*a*-12*d* being connected to respective ones of a plurality of support poles 16*a*-16*d*. The support poles 16*a*-16*d* are disposed in spaced relation to each other and are positioned to allow the net system 12 to be deployed in the configuration shown in FIG. 1.

Figure 2:
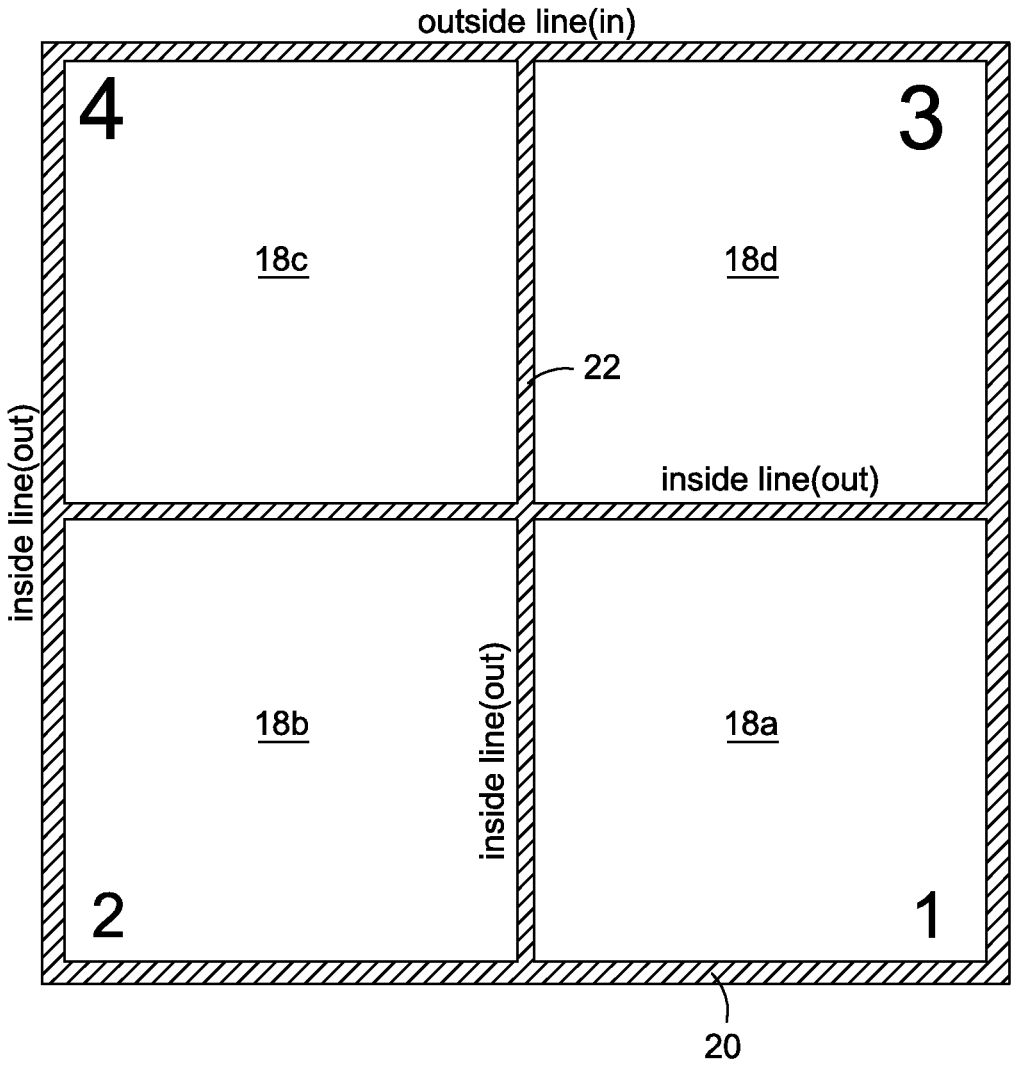
FIG. 2 is a top plan view of a playing surface defined by the game apparatus depicted in FIG. 1.
Figure 3:
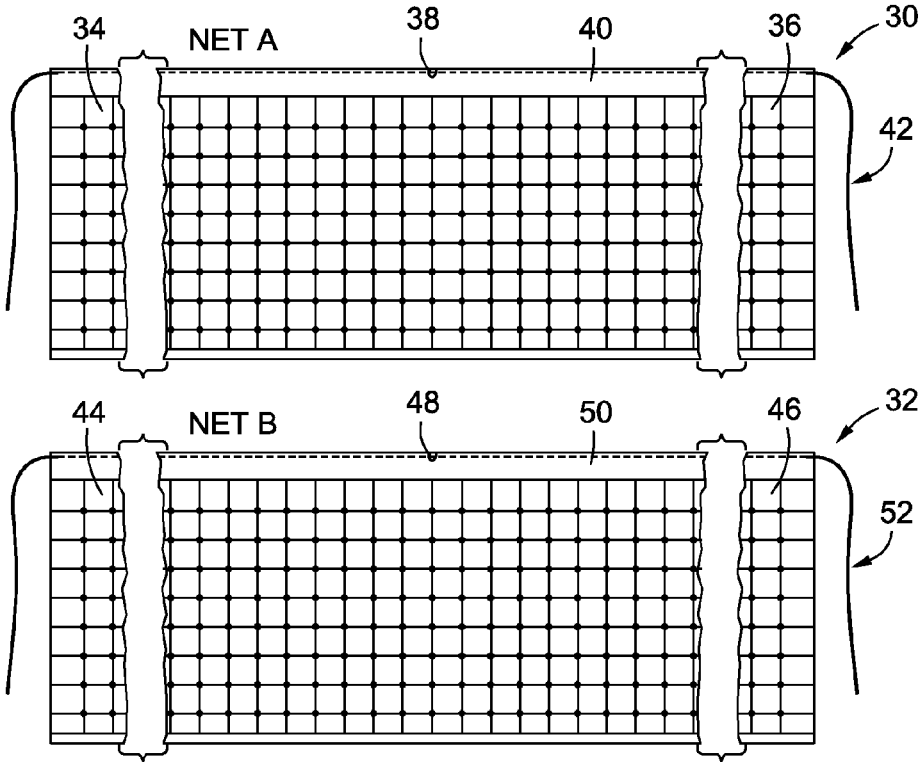
FIGS. 3-6 depict a method of creating a perpendicular net system from two volleyball nets.
Figure 4:
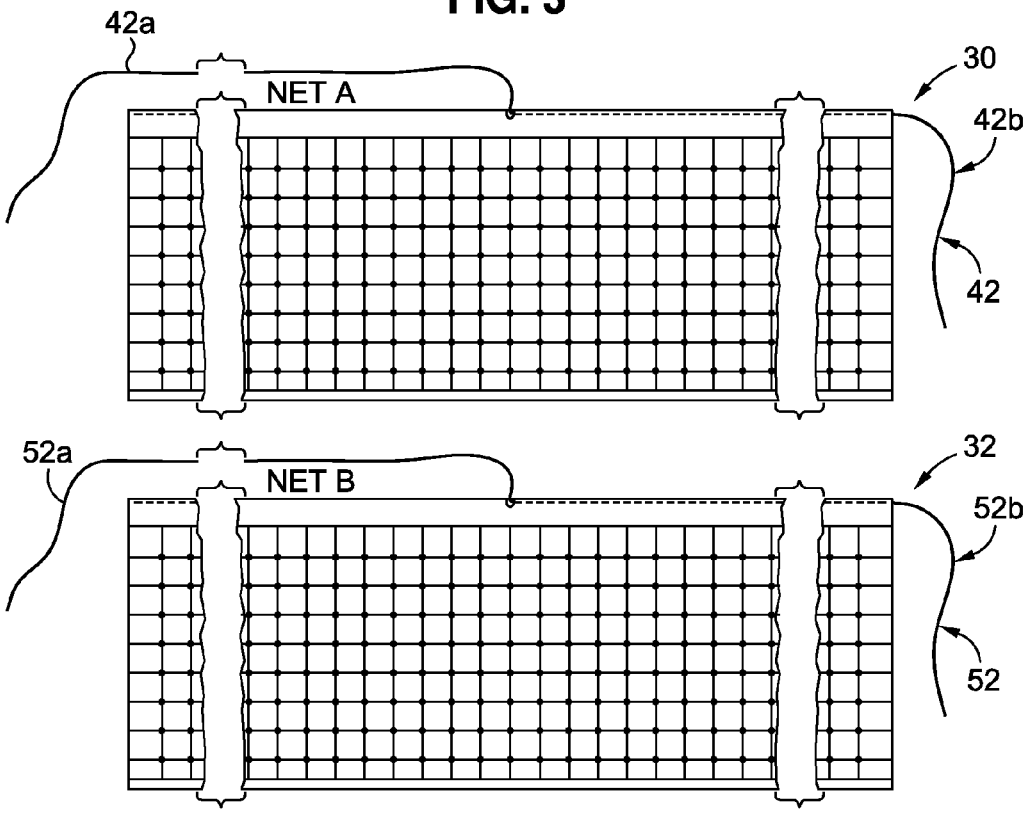

The game is played on a playing surface including four quadrants 18*a*-18*d*, wherein the outer boundaries of the quadrants 18*a*-18*d* are defined by an outer boundary member 20, which defines a generally square configuration. The inner boundaries of the quadrants 18*a*-18*d* are defined by an inner boundary member 22, which defines a perpendicular cross, or "+" configuration. The net system 12 is preferably elevated above the playing surface and is substantially aligned with the inner boundary member 22. The outer and inner boundary members 20, 22 may include tape, string, lines, markings in the ground, or other forms of demarcation known by those skilled in the art. A top plan view of the playing surface, including the quadrants 18*a*-18*d* as well as the outer and inner boundary members 20, 22 is shown in FIG. 2.

The net system 12 shown in FIG. 1 includes a single net, wherein the first, second, third and fourth net portions 12*a*-12*d* are integrally formed to each other. In other words, the first, second, third and fourth net portions 12*a*-12*d* are not configured to be easily attachable/detachable to each other. Rather, the net system 12 illustrated in FIG. 1 is preferably packaged and sold as a single unit including all four net portions 12*a*-12*d*.

Referring now to FIGS. 3-6, there is shown an alternate system and method of constructing the net system 12. In the embodiment depicted in FIGS. 3-6, the net system 12 is constructed from two existing conventional volleyball nets, specifically a first net 30 and a second net 32. The first net 30 defines a first end portion 34, a second end portion 36 and an approximate midpoint 38 disposed between the first end portion 34 and the second end portion 36. Furthermore, the first net 30 includes a strip or band 40 disposed adjacent the upper edge of the first net 30, wherein the strip 40 defines an inner channel sized to receive a first tension chord 42.

The second net 32 is similar to the first net 30 and includes a first end portion 44, a second end portion 46 and an approximate midpoint 48 disposed between the first end portion 44 and the second end portion 46. A strip 50 runs along the upper edge of the second net 32 and defines an inner channel sized to receive a second tension chord 52.

It is contemplated that each net 30, 32 may be used individually and separately from the other net 30, 32, such as during a conventional game of volleyball. When each net 30, 32 is used individually, the tension chord 42, 52 is tied between two supports to place the tension chord 42, 52 in generally a generally horizontal state to allow the respective net 30, 32 to hang therefrom.

Various aspects of the present invention are directed toward adapting the first and second nets 30, 32 to dispose the nets 30, 32 in the intersecting configuration shown in FIG. 1. The midpoints 38, 48 of the first and second nets 30, 32 are identified on each net 30, 32. This may be performed by folding the nets 30, 32 in half, or measuring the length of the nets 30, 32 to determine their approximate midpoint 38, 48.

After the midpoint 38, 48 on each net 30, 32 is found, a notch is cut into the upper strip 40, 50 of each net 30, 32 to access the first and second tension chords 42, 52. A portion of each tension chord 42, 52 is removed from the respective strip 42, 52 to define an exposed portion 42*a*, 52*a* and a confined portion 42*b*, 52*b* (see FIG. 4).

Figure 5:
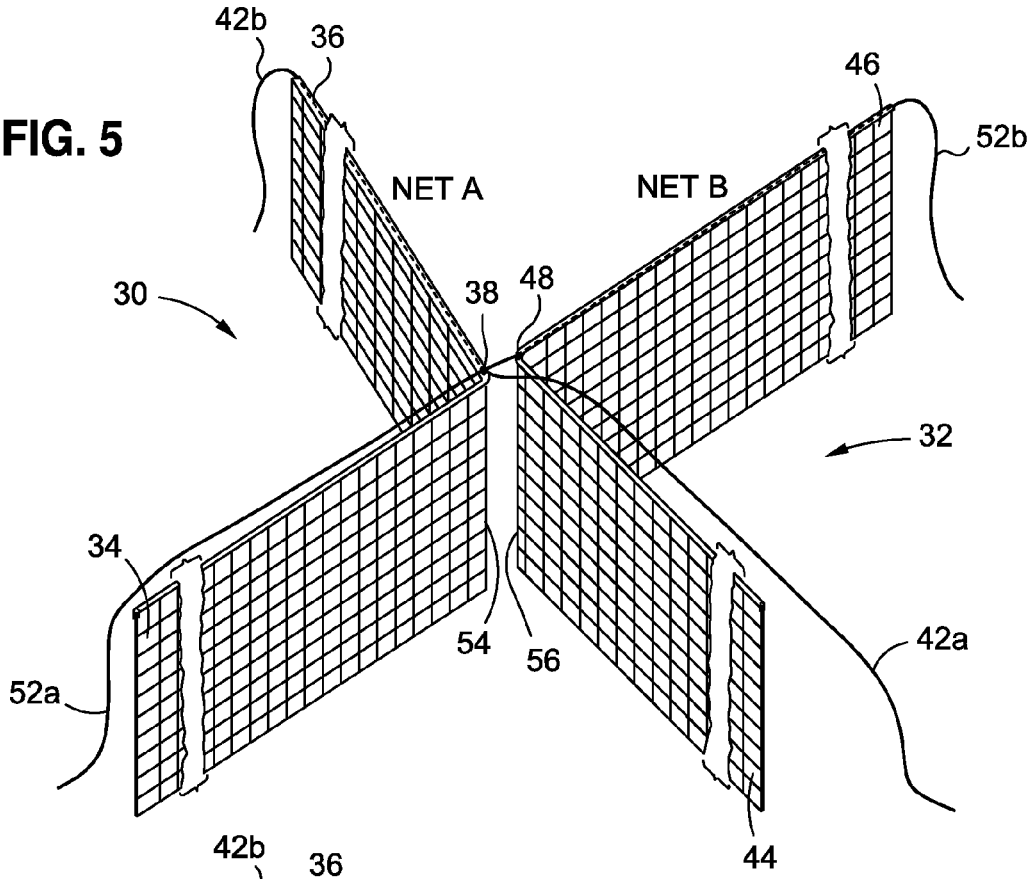

Referring now to FIG. 5, each net 30, 32 is then folded to form a generally perpendicular "L" shape. More specifically, the first net 30 is folded about the midpoint 38 such that the first end portion 34 and the second end portion 36 are no longer in co-planar alignment with each other, and are instead form a generally perpendicular configuration. Likewise, the second net 32 is folded about the midpoint 48 to place the first end portion 44 and the second end portion 46 in generally perpendicular configuration.

The nets 30, 32 are then placed next to each other adjacent the midpoints 38, 48 to form a generally perpendicular cross or "+" shape. In this regard, the first end portion 34 of the first net 30 is disposed in substantially co-planar alignment with the second end portion 46 of the second net 32, and the second end portion 36 of the first net 30 is placed in substantially co-planar alignment with the first end portion 44 of the second net 32.

The nets 30, 32 are joined together by threading each tension chord 42, 52 through both of the nets 30, 32. More specifically, the exposed portion 42*a* of the first tension chord 42 is advanced through the upper strip 50 at the first end portion 44 of the second net 32, while the confined portion 42*b* of the first tension chord 42 remains within the second end portion 36 of the first net 30. In this regard, the first tension chord 42 passes through portions of the first net 30 and the second net 32. The second tension chord 52 is also threaded through portions of the first net 30 and the second net 32. As shown in FIG. 5, the exposed portion 52 of the second tension chord 52 is advanced through the first end portion 34 of the first net 30, while the confined portion 52*b* of the second tension chord 52 remains in the second end portion 46 of the second net 32. Thus, with the tension chords 42, 52 threaded through both of the nets 30, 32, the nets 30, 32 may be joined into the perpendicular cross configuration.

Figure 6:
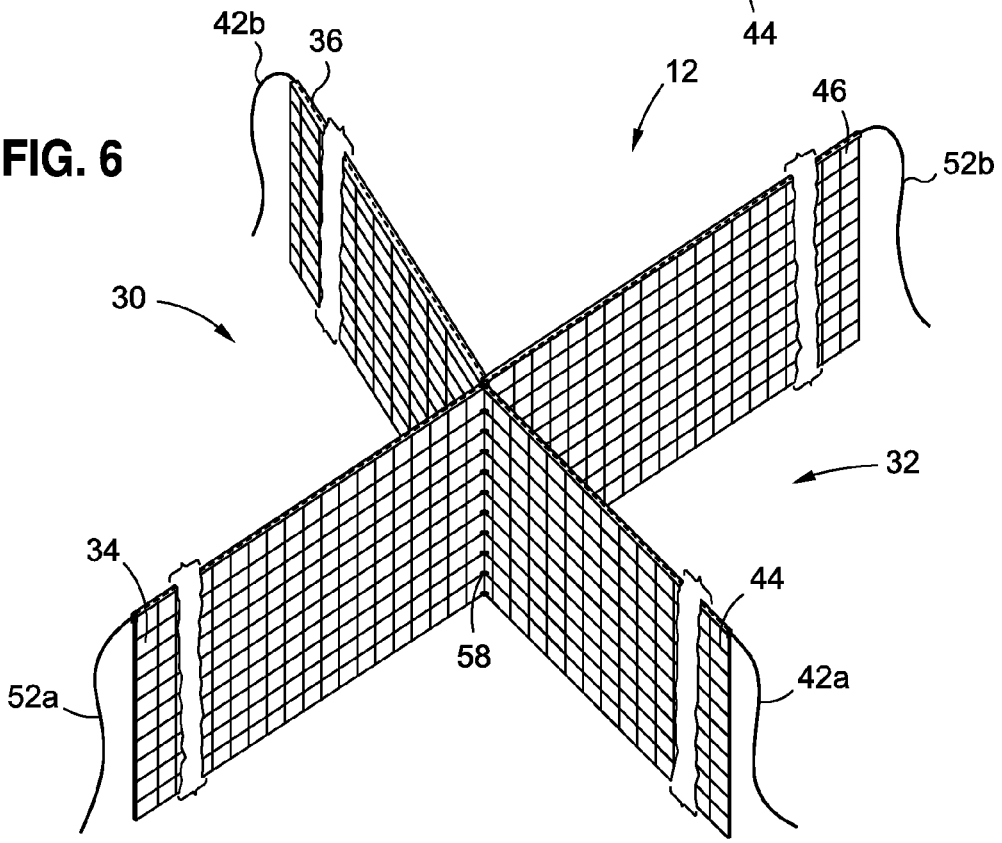

The fold line 54 of the first net 30 may be joined to the fold line 56 of the second net 32 to enhance the connection between the first and second nets 30, 32 (see FIGS. 5 and 6). Mechanical fasteners 58 may be used to join the first and second nets 30, 32 along the respective fold lines 54, 56. Exemplary mechanical fasteners 58 include hook and loop fasteners (i.e., Velcro®), snaps, buttons, clips, buckles, threaded connects, or other mechanical fasteners known by those skilled in the art.

To disassemble the net system 12 shown in FIG. 6, mechanical fasteners 58 are unfastened and the exposed portions 42*a*, 52*a* of the tethers 42, 52 are removed from the second net 32 and first net 30, respectively. The exposed portion 42*a* may be returned to the first end portion 34 of the first net 30 and the exposed portion 52*a* may be returned to the first end portion 44 of the second net 32 to allow for individual usage of the first and second nets 30, 32. In this regard, the system and method described above allows the first and second nets 30, 32 to quickly and easily transition between use as separate nets for conventional single net games, such as volleyball, badminton, and the like, as well as use in the joined perpendicular configuration. Furthermore, the first and second nets 30, 32 may be specifically configured and adapted for use in the perpendicular orientation without the use of a center pole. In other words, a center pole is not required to join the first net 30 and the second net 32 in the intersecting, perpendicular alignment shown in FIG. 6. Rather, the tension chords 42, 52 may be connected to peripheral poles located outside of the playing surface, so as to mitigate safety concerns while playing the game.

Figure 7:
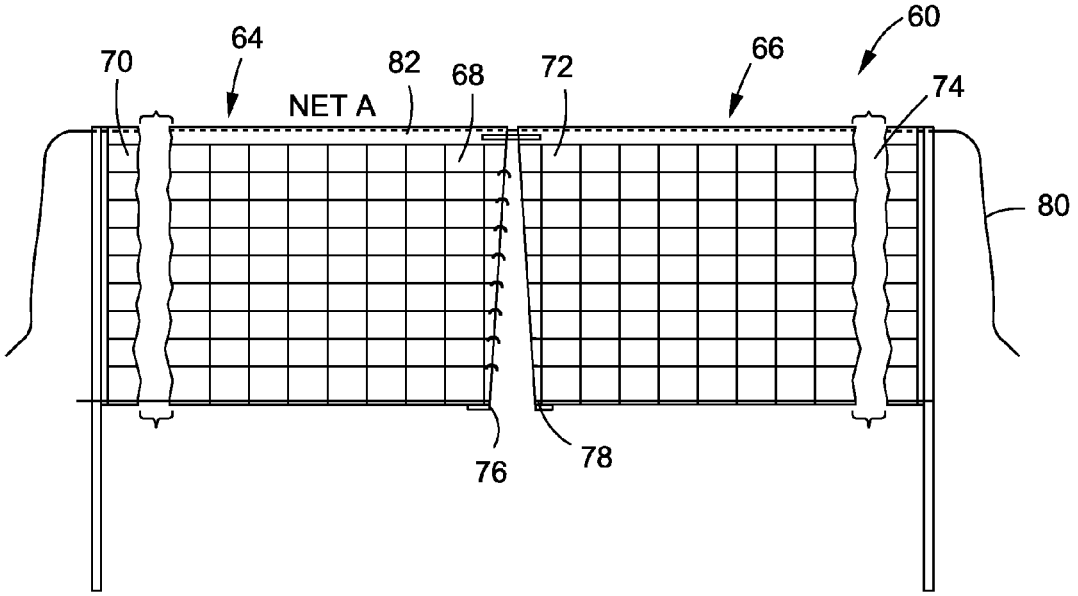
FIG. 7 is a front view of an adaptable net kit including a first net portion and a second net portion configured to be detachably connectable to the first net portion.
Figure 8:
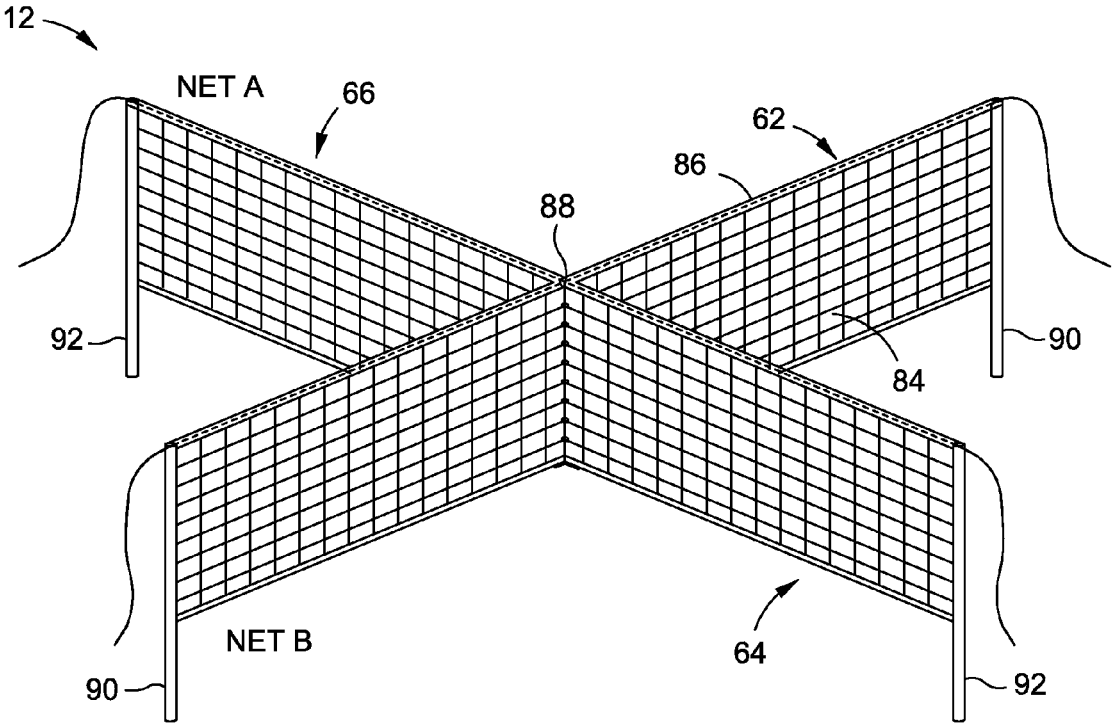
FIG. 8 is an upper perspective view of the adaptable net kit connected to an existing volleyball net to define a perpendicular net system.

Referring now to FIGS. 7 and 8, there is shown another embodiment of the net system 12 which includes adapter net 60 specifically configured and adapted for use with a conventional volleyball net 62 to transform the volleyball net 62 into the perpendicular net system 12. Along these lines, the adapter net 60 may be selectively attached/detached to the volleyball net 62 as desired by the user to create the net system 12.

The adapter net 60 includes a first net segment 64 and a second net segment 66. The first net segment 64 includes a medial portion 68 and a lateral portion 70, and the second net segment 66 includes a medial portion 72 and a lateral portion 74. The medial portions 68, 72 include complimentary mechanical fasteners 76, 78 which are cooperatively engageable to connect the first net segment 64 to the second net segment 66.

The adapter net 60 additionally includes a tension chord 80 which passes through a strip 82 collectively defined by the first net segment 64 and the second net segment 66 when the first and second net segments 64, 66 are joined together.

The existing net 62 defines a first face 84 and an opposing second face 86 and a midpoint 88. The adapter net 60 is connected to the existing net 62 by placing the first net segment 64 in perpendicular alignment the net 62, wherein the first net segment 64 extends from the first face 84 of the net 62. The second net segment 66 is placed in perpendicular alignment to the net 62 and extends from the second face 86 adjacent the midpoint 88 in substantially coplanar alignment with the first net segment 64.

Those skilled in the art will appreciate that various volleyball courts include support poles 90 permanently secured to the ground. A user may then bring their own net 62 and connect the net 62 to the poles 90 to place the net 62 in a deployed configuration. Such support poles 90 are commonly found at beaches, parks, schools, etc. The adapter net 60 may be used on such courts by connecting the net 60 to the net 62 as described above. Furthermore, the adapter net 60 may include adapter poles 92 for supporting the adapter net 62 in the deployed configuration. Along these lines, the first net segment 64 may be connected to an adapter pole 92 and the second net segment 66 may be connected to a separate adapter pole 92 to provide all of the hardware needed to erect the net system 12 on a court having a pair of permanently mounted support poles 90.

The adapter poles 92 may be configured for use on various playing surfaces. In this regard, the adapter poles 92 may have a pointed tip to allow the adapter pole 92 to be secured within the sand at a beach, or on a beach volleyball court. The adapter poles 92 may also have a weighted base to allow the adapter pole 92 to be erected on a field or paved surface.

Furthermore, although the foregoing describes the adapter net 60 as being connectable to a volleyball net 62, those skilled in the art will appreciate that the adapter net 60 may be connected to various nets or barriers without departing from the spirit and scope of the present invention. For instance, the adapter net 60 may be connected to a tennis net to create a perpendicular intersecting net structure. Thus, to facilitate such adaptability for connection with conventional volleyball nets, tennis nets and the like, the adapter poles 92 may be adjustable in length to place the adapter net 60 at the height of the net 62 to which the adapter net 60 is being connected. The adapter poles 92 may define a shorter length when the adapter net 60 is connected to a conventional tennis court net, and the adapter poles 92 may define a longer length when the adapter net 60 is connected to a conventional volleyball net.

It is also contemplated that the adapter net 60 may be used by itself to define a single net for volleyball, badminton or the like. In this regard, the first and second net halves 64, 66 may be connected to each other to define the net. As such, the adapter net 60 is highly adaptable and may be deployed for use as a single net or in combination with another net to define the intersecting net system 12.

Figure 9:
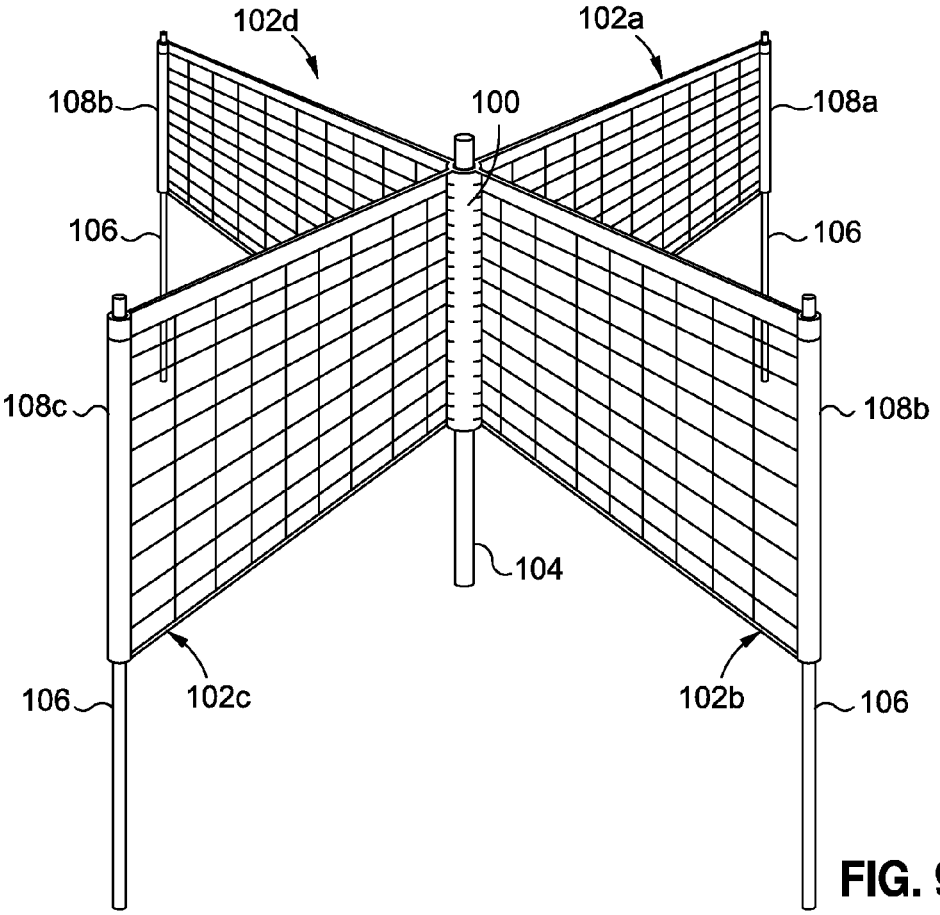
FIG. 9 is an upper perspective view of another embodiment of an intersecting net system including a center sleeve at the intersection of the nets to facilitate deployment and tear-down of the net system.
Figure 10:
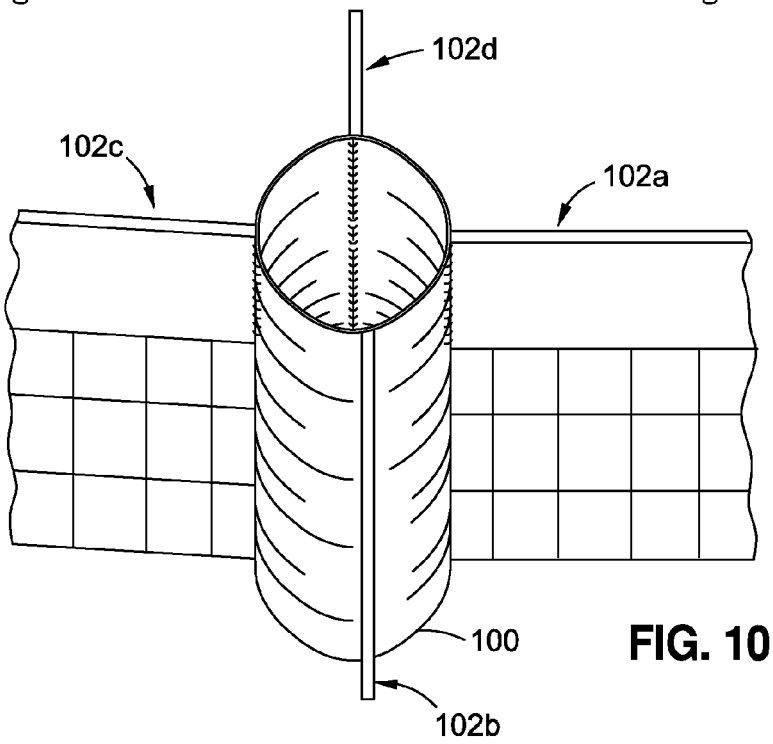
FIG. 10 is an enlarged sectional upper perspective view of the center sleeve used in the net system depicted in FIG. 9.
Figure 11:
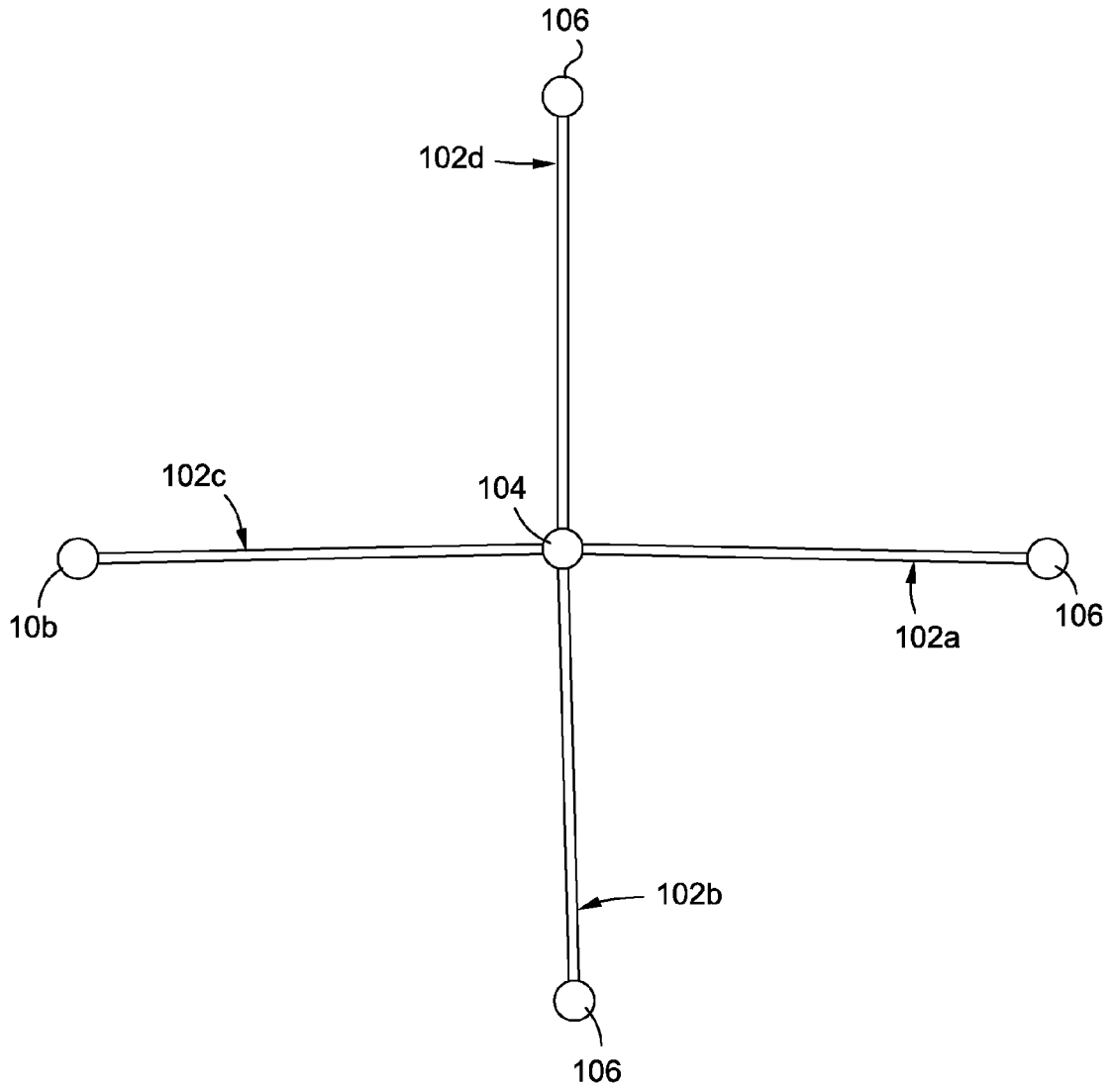
FIG. 11 is a top plan view of the net system illustrated in FIGS. 9 and 10 in a deployed state.

Referring now to FIGS. 9 and 10, there is shown another embodiment of the net system 12, which includes a center sleeve 100 from which a first net portion 102*a*, second net portion 102*b*, third net portion 102*c*, and fourth net portion 102*d* protrude radially outwardly therefrom. The center sleeve 100 is sized and configured to receive a center pole

104 which may be used during assembly and disassembly of the net system 12, and may be removed during usage of the net system 12.

In addition to the center pole 104, there are four peripheral poles 106 which provide support to the distal ends of the net portions 102*a-d*. As shown, each net portion 102*a-d* includes a distal sleeve 108*a-d* which is configured to slide over respective ones of the peripheral poles 106. Although each net portion includes sleeve 108*a-d* for connecting the net portions 102*a-d* to the peripheral poles 106, it is also contemplated that tension cords, buckles, hooks, or other mechanical fasteners known by those skilled in the art may be used without departing from the spirit and scope of the present invention.

As previously mentioned, the center sleeve 100 and center pole 104 may facilitate assembly and disassembly of the net system 12. More specifically, when the time comes to tear-down or disassemble the net system 12, the center pole 104 may once again be employed to facilitate such removal. Along these lines, the center pole 104 may be advanced into the center sleeve 104 to assume an erect position (as shown in FIG. 9). At this point, the center pole 104 is disposed within the center sleeve 100 and the peripheral poles 106 are disposed within the distal sleeves 108*a-d*. To take down the net system 12, the user may remove one of the peripheral poles 106 and carry it while walking toward an adjacent peripheral pole 106. The user may continue this process until all of the peripheral poles 106 are removed. After removing the final peripheral pole 106, the net portions 102*a-d* and the poles 106 may be wrapped around the center sleeve 100 and the center pole 104 to assume a compact storage configuration.

To deploy the net system from the storage configuration, the center pole 104 is placed in the center of playing court and the net portions 102*a-d* are stretched and unwound from the center pole 104. Therefore, the user may quickly and easily transition the system from the storage configuration to the deployed configuration, and vice-versa.

Although the foregoing describes various embodiments of the net system 12, those skilled in the art will understand that the specific embodiments described above and shown in the accompanying drawings are for illustrative purposes only and are not intended to limit the scope of the present invention. Along these lines, it is contemplated that certain features shown and described in relation to one embodiment may be used in connection with another embodiment. For instance, the center sleeve 100 is described as being part of an integral net system, although it is understood that the center sleeve 100 may be adapted for use with the net system 12 shown in FIGS. 7 and 8, wherein the center sleeve 100 is connectable to the net halves 64, 66. Furthermore, the center sleeve 100 may also be incorporated into the net system 12 shown in FIGS. 3-6, wherein the first and second nets 30, 32 are connectable to the center sleeve 100 at their respective midpoints 38, 48.

With the various embodiments of the net system 12 described above, the following is an exemplary method of playing a game on the apparatus. The object of the game is to eliminate players in higher numbered squares (see FIG. 2) so that you can advance to the highest square yourself. The game may be played with a regulation volleyball on a square court with four or eight (pairs) players, each occupying a quarter of the court. The ball is volleyed between players in squares until someone makes an error and is eliminated. Eliminated players leave the court, all players advance to fill the empty squares, and a new player joins at the lowest ranked square.

Referring now to FIG. 2, the game may be played on a square court divided into four smaller squares that meet in the center. The squares are numbered 1 through 4 or associated with such number, with the highest ranked square being 4.

There are two sets of lines on the court. "Outside lines" 20 are the outermost edges of the entire court, while "inside lines" 22 refer to the line dividing individual squares of the court that cross in the center. Outside lines 20 are in-bounds. If a player bounces the ball onto any outside line 20, it is still in play. However, if the ball bounces outside of the outside line 20, it is out of bounds and the player that last hit it is eliminated. Inside lines 22 are out-of-bounds. If a player hits a ball onto any inside line 22 then that player is out. This applies to all inside lines 22, not just the lines that border her square. If a ball touches an inside line 22, the player that hit the ball last is eliminated. Players are not required to stay in their portion of the court. They may stand, walk or run anywhere on the court, though it is best to stay in a position to protect your own square.

The ball is served from the highest ranked square to the lowest square. Squares one and four are positioned diagonally across the court from each other. The server must serve the ball into another square of his or her choice. After the receiver touches the ball, the ball is in play. Serves are meant to place the ball fairly into play. Because the server must serve the ball the same way each time, it is the receiving player who actually controls the first move of the game.

Each time a player is eliminated, that player leaves the court and all players advance to higher numbered square squares. The lowest ranked square is then filled with a new player. Eliminated players must go to the end of the line and await their next turn in play.

These following situations represent various ways in which a player may be eliminated from the court. All eliminated players leave the court and wait for their next turn to join in the lowest square. Players may be eliminated for: 1) Failing to hit the ball into another square; 2) Hitting the ball out of turn (poaching); 3) Hitting the ball incorrectly; 3) Hitting the ball out of bounds or onto an inside line; 4) Holding, catching or carrying the ball; or 5) Violating any number of local rules that are made up on the playground.

If the ball is touched by another object which is not one of the four players or the floor, this is called interference. The round is started again. Players waiting in line may not touch the ball when in play.

The foregoing is one exemplary method of playing a game on the net apparatus 12, and it is understood that modifications may be made to the game without departing from the spirit and scope of the present invention. Furthermore, although the foregoing describes a game wherein aspects of volleyball and four square are combined, those skilled in the art will appreciate that the net system 12 described herein may be used in various games which borrow aspects from tennis, table tennis, badminton, squash, kickball, soccer, baseball, or other games known by those skilled in the art. In this regard, the specifics discussed herein are exemplary in nature only and are not intended to limit the scope of the present invention.

Additional modifications and improvements of the present invention may also be apparent to those of ordinary skill in the art. Thus, the particular combination of components and steps described and illustrated herein is intended to represent only certain embodiments of the present invention, and is not intended to serve as limitations of alternative devices and methods within the spirit and scope of the invention.

What is claimed is:

1. A unitary net apparatus for use with a plurality of distal support members, the unitary net apparatus comprising:

a plurality of net segments coupled to each other to form a single, integral unit and extending radially outward from a common central axis, each net segment extending away from the common central axis and terminating at a distal end region, at least two of the plurality of net segments being disposed in a non-planar relationship to each other, each net segment being configured to be engageable with a respective one of the plurality of distal support members at the distal end region for supporting the plurality of net segments above a ground surface;

the net apparatus being adapted to be supported above the ground surface independent of a support at the central axis.

2. The net apparatus recited in claim 1, wherein at least two of the plurality of net segments are substantially perpendicular to each other.

3. The net apparatus recited in claim 1, wherein the plurality of net segments includes four net segments.

4. The net apparatus recited in claim 1, wherein the plurality of net segments are spaced from each other in approximately 90 degree increments.

5. The net apparatus recited in claim 1, wherein the plurality of net segments are substantially evenly spaced about the common axis.

6. The net apparatus recited in claim 1, wherein each net segment extends from the common axis to define a length, the lengths of the plurality of net segments being substantially equal to each other.

7. The net apparatus recited in claim 1, wherein a first pair of net segments are co-planar and define a first continuous net element.

8. The net apparatus recited in claim 7, wherein a second pair of net segments are co-planar and define a second continuous net element offset from the first continuous net element.

9. A net system comprising:

a plurality of support members; and a plurality of net segments coupled to each other to form a single, integral unit and extending radially outward from a common central axis, each net segment extending away from the common central axis and terminating at a distal end region, at least two of the plurality of net segments being disposed in a non-planar relationship to each other, each net segment being configured to be engageable with a respective one of the plurality of support members at the distal end region for supporting the plurality of net segments above a ground surface;

the net system being adapted to be supported above the ground surface independent of a support at the central axis.

10. The net system recited in claim 9, wherein at least two of the plurality of net segments are substantially perpendicular to each other.

11. The net system recited in claim 9, wherein the plurality of net segments includes four net segments.

12. The net system recited in claim 9, wherein the plurality of net segments are spaced from each other in approximately 90 degree increments.

13. The net system recited in claim 9, wherein the plurality of net segments are substantially evenly spaced about the common axis.

14. The net system recited in claim 9, wherein each net segment extends from the common axis to define a length, the lengths of the plurality of net segments being substantially equal to each other.

15. The net system recited in claim 9, wherein a first pair of net segments are co-planar and define a first continuous net element.

16. The net system recited in claim 15, wherein a second pair of net segments are co-planar and define a second continuous net element offset from the first continuous net element.

17. The net system recited in claim 9, further comprising a plurality of collars coupled to respective ones of the plurality of net segments, wherein each collar is adapted to receive a respective one of the plurality of support members for connecting the support members to the net segments.

18. The net system recited in claim 9, wherein the support members are selectively engageable with the net segments.

* * * * *